US009032925B2

(12) United States Patent
Kameda et al.

(10) Patent No.: US 9,032,925 B2
(45) Date of Patent: May 19, 2015

(54) PHASE VARYING APPARATUS FOR AUTOMOBILE ENGINE

(75) Inventors: Michihiro Kameda, Hadano (JP); Masaaki Niiro, Hadano (JP); Koichi Homma, Hadano (JP)

(73) Assignee: NITTAN VALVE CO., LTD., Hadano-shi (JP)

( * ) Notice: Subject to any disclaimer, the term of this patent is extended or adjusted under 35 U.S.C. 154(b) by 0 days.

(21) Appl. No.: 14/238,380

(22) PCT Filed: Aug. 12, 2011

(86) PCT No.: PCT/JP2011/068428
§ 371 (c)(1),
(2), (4) Date: Feb. 11, 2014

(87) PCT Pub. No.: WO2013/024513
PCT Pub. Date: Feb. 21, 2013

(65) Prior Publication Data

US 2014/0196677 A1 Jul. 17, 2014

(51) Int. Cl.
*F01L 1/34* (2006.01)
*F01L 1/344* (2006.01)
*F01L 1/352* (2006.01)

(52) U.S. Cl.
CPC ..... *F01L 1/344* (2013.01); *F01L 1/352* (2013.01); *F01L 2001/3522* (2013.01)

(58) Field of Classification Search
CPC .... F01L 1/344; F01L 1/352; F01L 2001/3522
USPC ..... 123/90.15, 90.17; 464/160
See application file for complete search history.

(56) References Cited

U.S. PATENT DOCUMENTS 8,286,602 B2 * 10/2012 Kameda et al. ..... 123/90.17

FOREIGN PATENT DOCUMENTS

| | | | |
|---|---|---|---|
| JP | 2004-100572 | A | 4/2004 |
| WO | 2009/110349 | A1 | 9/2009 |
| WO | 2010/026645 | A1 | 3/2010 |
| WO | 2010/046974 | A1 | 4/2010 |

OTHER PUBLICATIONS

International Search Report dated Sep. 6, 2011, issued in corresponding application No. PCT/JP2011/068428.

* cited by examiner

*Primary Examiner* — Ching Chang
(74) *Attorney, Agent, or Firm* — Westerman, Hattori, Daniels & Adrian, LLP

(57) ABSTRACT

A phase varying apparatus capable of smoothly varying the phase angle of a camshaft relative to a drive rotor by comprising: a drive rotor supported by a camshaft and driven by a crankshaft; a first control rotor integral with the camshaft; a first torquing mechanism for providing the first drive rotor with a torque in one direction, and a reverse rotation mechanism for proving the first control rotor with a torque in the opposite direction, wherein the reverse rotation mechanism comprises a first radius-decreasing guide groove formed in the control rotor, a crank member adapted to rotate about a position offset from the rotational axis of the drive rotor, and a first pin mechanism mounted on the crank member and movable in the radius-decreasing guide groove, and a second operative mechanism for rotating the first control rotor in the opposite rotational direction relative to the drive rotor.

8 Claims, 12 Drawing Sheets

SECTION A-A

SECTION G-G

PHASE VARYING APPARATUS FOR AUTOMOBILE ENGINE

TECHNICAL FIELD

This invention relates to a phase varying device for use with an automobile engine, for varying the phase angle of a camshaft relative to a crankshaft to vary opening/closing timing of a valve.

BACKGROUND ART

A phase varying apparatus for an automobile engine adapted to vary the phase angle between the crankshaft and camshaft of the engine to vary valve timing is disclosed in Patent Document 1 cited below. This Patent Document 1 has a camshaft a drive rotor driven by the crankshaft and rotatably mounted on a center shaft which is integral with the camshaft, a first and a second control rotor rotatably mounted on a center shaft, a first and a second electromagnetic clutch for putting a brake on the first and the second control rotor, respectively.

The first control rotor can rotate in the phase retarding direction relative to the camshaft as it is braked by the first electromagnetic clutch. Consequently, a first intermediate rotor and a shaft member, mounted on the center shaft are moved in the radial direction of a second intermediate rotor. The first intermediate rotor is mounted on the center shaft unrotatably relative thereto but moveable in the direction perpendicular to the axis of the center shaft. The shaft member, moveable in the radial direction of the second intermediate rotor, can move in a guide groove that has a shrinking radius formed in a drive cylinder to thereby rotate the first intermediate rotor and the center shaft relative to the drive rotor. As a result, the phase angle of the camshaft relative to the drive rotor is altered either in the phase advancing direction D1 or phase retarding direction D2.

On the other hand, provided between the front end of the first control rotor and the second control rotor is the second intermediate rotor, which has a guide groove extending substantially in the radial direction (the groove hereinafter referred to as radial groove) and is fixedly secured to the center shaft. Formed in the front end of the first control rotor and in the rear end of the second control rotor are eccentric circular holes, respectively, in which, and across the second intermediate rotor, a second and a first ring member are engaged respectively. The second and first ring members are connected to the opposite ends of the shaft member which is passed through the radial guide groove. The second control rotor, when subjected to a braking force of the second electromagnetic clutch, rotates the second ring member in the eccentric circular hole and displaces the shaft member in the radial guide. The displaced shaft member causes the first ring member to rotates in the eccentric circular hole, which in turn causes the first control rotor to rotate in the phase advancing direction relative to the drive rotor. Consequently, by energization of the second electromagnetic clutch, the phase angle of the camshaft relative to the drive rotor is varied in the opposite sense as compared with the phase angular variation caused by energization of the first electromagnetic clutch.

PRIOR ART REFERENCES

Patent Document

Patent Document 1 WO2010/026645

BRIEF SUMMARY OF THE INVENTION

In the phase varying apparatus disclosed in Patent Document 1 when either one of the first and the second control rotor is activated, one of the ring members is rotated in the eccentric circular hole, which in turn causes the shaft member in engagement with the radial guide groove to rotate the other ring member, thereby rotating the other one of the first and the second control rotor in the opposite direction relative to the braked rotor.

However, the opposite ends of the shaft member acting as points of effort are separated in the front-back direction across the second intermediate rotor. The shaft member is not fixed in position not to incline towards the axis of the camshaft. Consequently, as one of the ring members is rotated in the eccentric circular hole, the shaft member in the radial guide groove is inclined towards the axis. Consequently, the phase angle of the camshaft relative to the drive rotor (crankshaft) is not smoothly altered, due to friction between the fallen or inclined shaft member and the radial guide groove in contact therewith.

In view of the problem mentioned above, the inventive is directed to provide a phase varying apparatus for an automobile engine, capable of smoothly varying the phase angle of the camshaft relative to the drive rotor.

Means for Achieving the Object

A phase varying apparatus for an automobile engine comprises, as recited in claim 1, a camshaft;

a drive rotor coaxially mounted on the camshaft, the drive rotor being rotatable about a first rotational axis under a torque exerted by the crankshaft;

a first control rotor integral with and coaxial with the camshaft;

a second control rotor coaxially and rotatably mounted on the camshaft;

a first torquing mechanism for rotating the first control rotor relative to the drive rotor;

a second torquing mechanism for rotating the second control rotor relative to the first control rotor; and a reverse rotation mechanism for rotating the first control rotor relative to the drive rotor in association with the second torquing mechanism, in the opposite rotational direction as compared with the rotational direction caused by the action of the first torquing mechanism, wherein the reverse rotation mechanism comprises:

a first operative mechanism having, a first guide groove formed in the first control rotor to extend substantially along a circumference of the first control rotor such that its radius from the first rotational axis decreases with the length of the groove (the groove will be hereinafter referred to as first radius-decreasing guide groove), a crank member mounted on the drive rotor rotatably about a second rotational axis which is offset from the first rotational axis, and a first pin mechanism mounted on the crank member such that the pin mechanism is in engagement with the first radius-decreasing curved guide groove slidably in one direction of the guide groove under the action of the first torquing mechanism; and a second operative mechanism for rotating the first control rotor relative to the drive rotor in the opposite rotational direction with respect to the rotation caused by the action of the first torquing mechanism, by moving the first pin mechanism in the first radial guide groove in the other direction, under the action of the second torquing mechanism.

(Function) The first pin mechanism is constrained not to incline towards the axis of the camshaft by being mounted on the crank member. Thus, no local frictional force is generated between the first pin mechanism and the first radial guide groove. As a result, under the action of the first and the second torquing mechanisms, the first pin mechanism in engagement with the first radial guide groove moves smoothly within the first radial guide groove.

The second operative mechanism of the phase varying apparatus recited in claim 1 may have a second guide groove formed in the second control rotor to extend substantially along the circumference of the second control rotor in the opposite direction as compared with the first radius-decreasing guide groove such that the radius of the second guide groove from the first rotational axis decreases with the length of the groove (the second guide groove hereinafter referred to as second radius-decreasing guide groove); and, a second pin mechanism mounted on the crank member and slidably engaged with the second radius-decreasing guide groove, as recited in claim 2.

(Function) The second pin mechanism is constrained not to incline towards the axis of the camshaft as it is mounted on the crank member in the same manner as the first pin mechanism. Thus, no local frictional force is generated between the second pin mechanism and the second radial guide groove. Consequently, the second pin mechanism can smoothly move within the second radial guide groove under the action of the first and/or second torquing mechanism.

The first and second pin mechanisms of the phase varying apparatus according to claim 2 may be formed as an integral body which can slidably move as a single pin mechanism in both of the first and the second radial guide grooves.

(Function) The single pin mechanism, when mounted on the crank member, is constrained not to incline towards the axis of the camshaft. Thus, the single pin mechanism can smoothly move within the first and the second radial guide grooves without incurring any local frictional force in the first nor second radial guide groove. It is noted that in the apparatus recited in claim 3 use of a single pin mechanism helps decrease the number of necessary elements of the apparatus on one hand and helps simplify the structure of the reverse rotation mechanism.

In the phase varying apparatus of claim 1, the second operative mechanism may have a link member which has one end rotatably mounted on the crank member and another end rotatably mounted on the second control rotor, as recited in claim 4.

(Function) Since the link member is mounted at one end thereof on the crank member and at the other end rotatably mounted on the second control rotor, the link member is constrained not to incline towards the crank member.

On the other hand, the crank member can rotate about the second rotational axis when the first pin mechanism is moved within the first radial guide groove in one direction by the first torquing mechanism. During this movement, the link member mounted on the second control rotor is rotated relative to the first control rotor in the opposite direction with respect to the rotation under the action of the second torquing mechanism acting on the second control rotor.

The link member is rotated about the second rotational axis in the opposite direction with respect to the rotation under the action of the first torquing mechanism when the second control rotor is rotated relative to the first control rotor by the second torquing mechanism. During this rotation, the first pin mechanism mounted on the crank member is moved within the first radial guide groove in the other direction (that is in the opposite direction with respect to the rotation under the action of the first torquing mechanism). Consequently, the first control rotor rotates relative to the drive rotor in the opposite direction with respect to the rotation under the action of the first torquing mechanism.

The crank member of the phase varying apparatus according to any one of claims 1 though 4 may be configured to have a center of gravity offset to the right or left of the line passing through the rotational axis of the crank member, as recited in claim 5.

(Function) With the center of gravity offset from the line passing through the first and the second rotational axes to the left, for example, the crank member is subjected to a counterclockwise torque about its rotational axis due to its own weight. If the center of gravity is offset to the right of the line passing through the first and the second rotational axes, the crank member is subjected to a counterclockwise torque due to its own weight.

By rendering the center of gravity of the crank member offset either to the right or left of the line passing through the first and the second rotational axes, it is possible to generate a rotational moment of its own weight (referred to as weight torque) that acts on the crank member itself. This weight torque supplements the torque for rotating the first control rotor (camshaft) relative to the drive rotor (crankshaft) generated by either the first torquing mechanism or the reverse rotation mechanism. That is, the crank member in operation is assisted by the centrifugal force to rotate in a particular direction.

Result of the Invention

In the phase varying apparatus for an automobile engine according to claims 1 and 2, the phase angle of the camshaft relative to the drive rotor can be smoothly varied.

In the phase varying apparatus for an automobile engine according to claim 3, the phase angle of the camshaft relative to the drive rotor can be smoothly varied. Furthermore, the apparatus can be manufactured in a easier process at a lower cost.

In the phase varying apparatus according to claim 4, the link member can rotate about the shaft of the second control rotor more smoothly as compared with the pin mechanism that moves within the second radial guide groove of claim 1. Thus, the phase angle of the camshaft can be varied unmistakably relative to the drive rotor (crankshaft).

In the phase varying apparatus according to claim 5, one of the first and the second torques acted upon the first control rotor is supplemented by the weight of the crank member, so that the phase angle of the camshaft relative to the drive rotor (crankshaft) can be varied more easily in one direction (either the phase advancing direction or phase retarding direction) than the other direction.

BEST MODE FOR CARRYING OUT THE INVENTION

Figure 1:
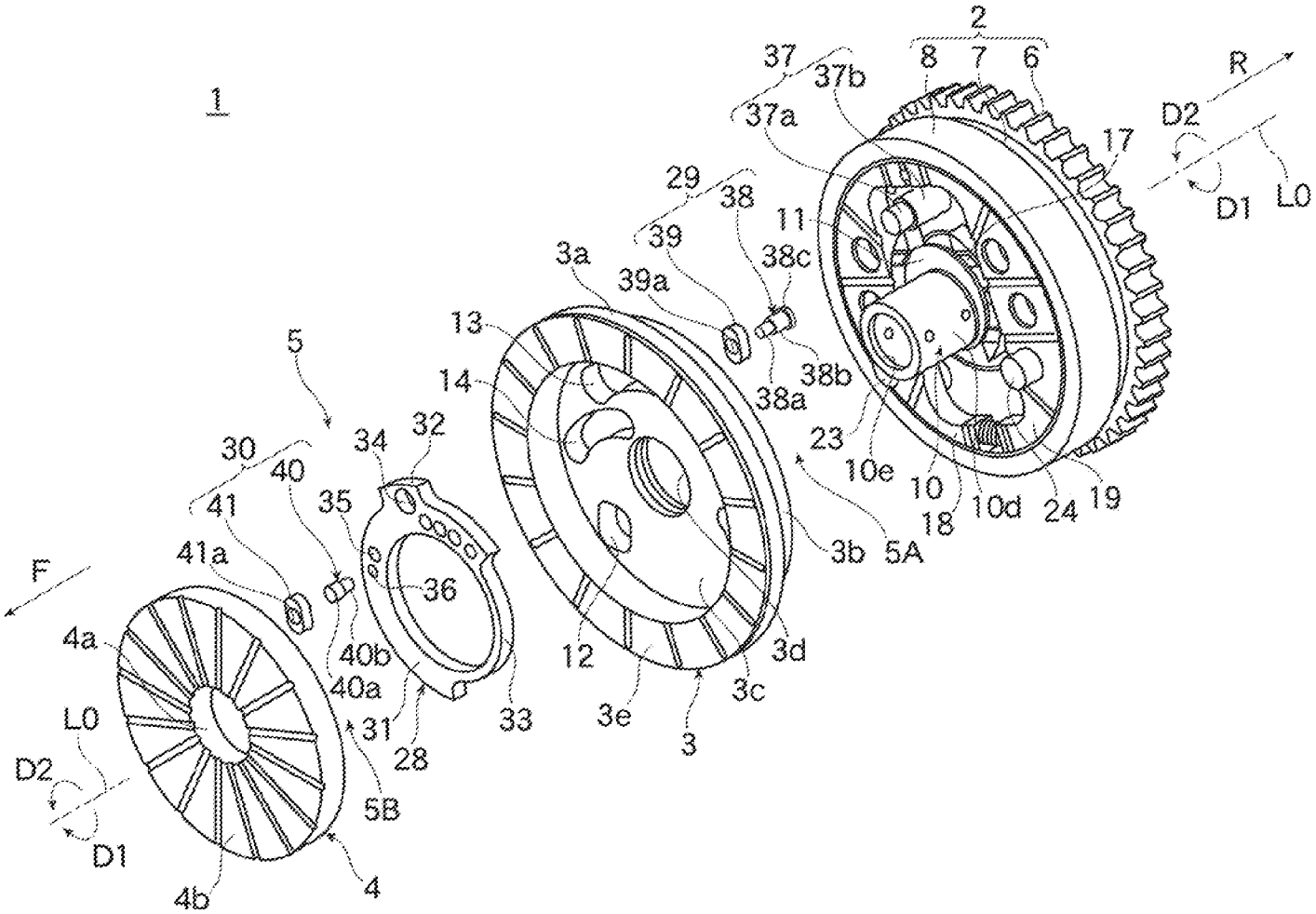
FIG. 1 is a perspective view of a phase varying apparatus for an automobile engine according to a first embodiment of the invention, as seen from the front end of the apparatus.
Figure 2:
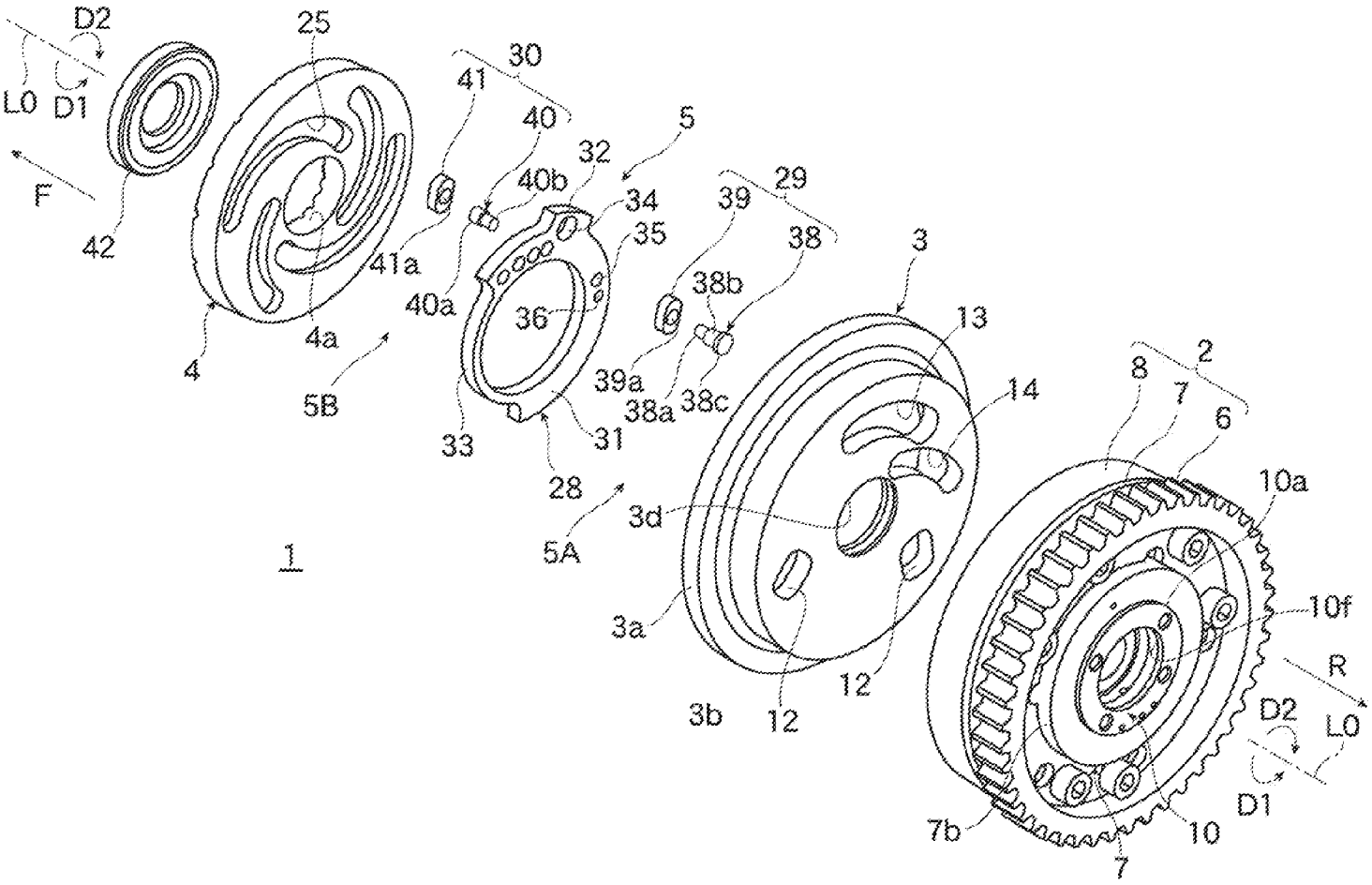
FIG. 2 is a perspective view of the apparatus of FIG. 1, as seen from the rear end of the apparatus.

The invention will be now described in detail by way of example with reference to the accompanying drawings. Each of phase varying apparatuses according to the embodiments shown below is mounted on an automobile engine in such a way that the rotational motion of the crankshaft of the engine, controlling opening/closing operation of an air intake/exhaust valve, is transmitted to a camshaft of the apparatus in synchronism with the crankshaft so as to vary opening/closing timing of the valve in accordance with such operational conditions as the engine load and rpm.

Referring to FIGS. 1 through 6, there is shown a phase varying apparatus 1 for an automobile engine of a first embodiment of the invention. The phase varying apparatus 1 for an automobile engine has a camshaft (not shown), a drive rotor 2 driven by the crankshaft (not shown), a first control rotor 3, a second control rotor 4, and a reverse rotation mechanism 5. In what follows one end of the apparatus having the second control rotor 4 will be referred to as front end (the direction towards the front end referred to as F-direction), and another end having the drive rotor 2 will be referred to as rear end (the direction towards the rear end referred to as R-direction). The clockwise rotational direction of the drive rotor 2 about a first rotational axis L0 as seen from the front end will be referred to as phase advancing direction D1, and the counterclockwise direction will be referred to as phase retarding direction D2.

The camshaft (not shown) is coaxially and fixedly mounted on a center shaft 10 having a first rotational axis L0. The drive rotor 2 consists of a sprocket 6 driven by the crankshaft, a sprocket holder member 7, and a drive cylinder 8. The drive rotor 2 is supported by the center shaft 10 rotatable about the first rotational axis L0.

Figure 4:
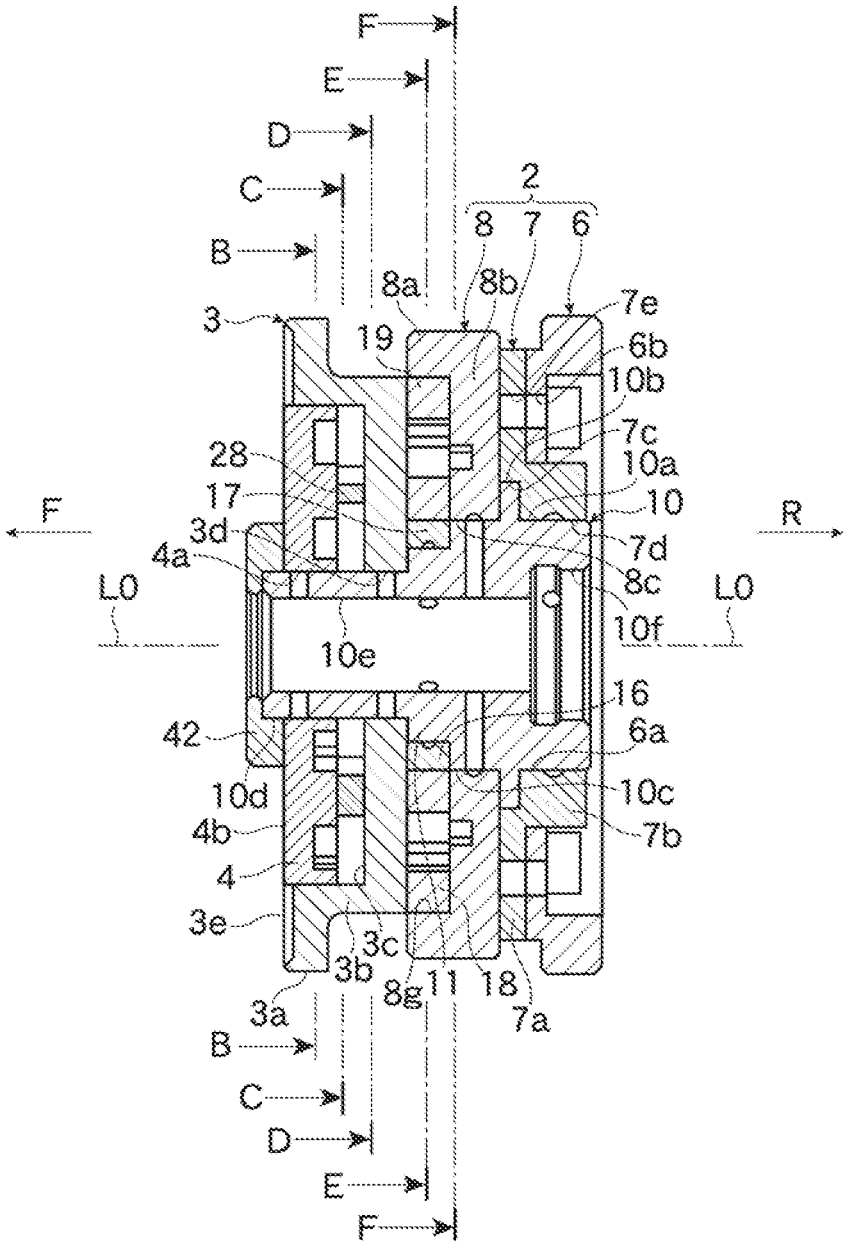
FIG. 4 is a cross section taken along line A-A in FIG. 3.

As shown in FIG. 4, the center shaft 10 consists of a first cylinder section 10*a*, a flange section 10*b*, a second cylinder section 10*c*, an circular eccentric cam 11 having a cam center L1 offset from the axis L0 of the camshaft, and a third cylinder section 10*d*, all arranged contiguously in the order mentioned from the rear towards the front end. Formed inside the camshaft is a bolt insertion through-hole 10*e*. Formed at the base section of the bolt insertion through-hole 10*e* is a camshaft fixing section 10*f* which is formed with a multiplicity of circular holes each having a larger diameter than the diameter of the bolt insertion through-hole 10*e*.

The drive rotor 2 consists of the sprocket 6, sprocket holder 7, and the drive cylinder 8. The sprocket holder 7 has a configuration that incorporates a flange section 7*a* and a cylinder section 7*b* which are integrally and coaxially arranged in a head-tail relationship. The sprocket holder 7 is formed at the central region thereof with a stepped circular hole 7*c* and a circular hole 7*d* contiguously with the rear end of the stepped circular hole 7*c*. The flange section 7*a* is formed with a multiplicity of pinholes 7*e*. The cylinder section 7*b* engages with a central circular hole 6*a* of the sprocket 6, so that the sprocket 6 is held on the cylinder section 7*b*.

Figure 6:
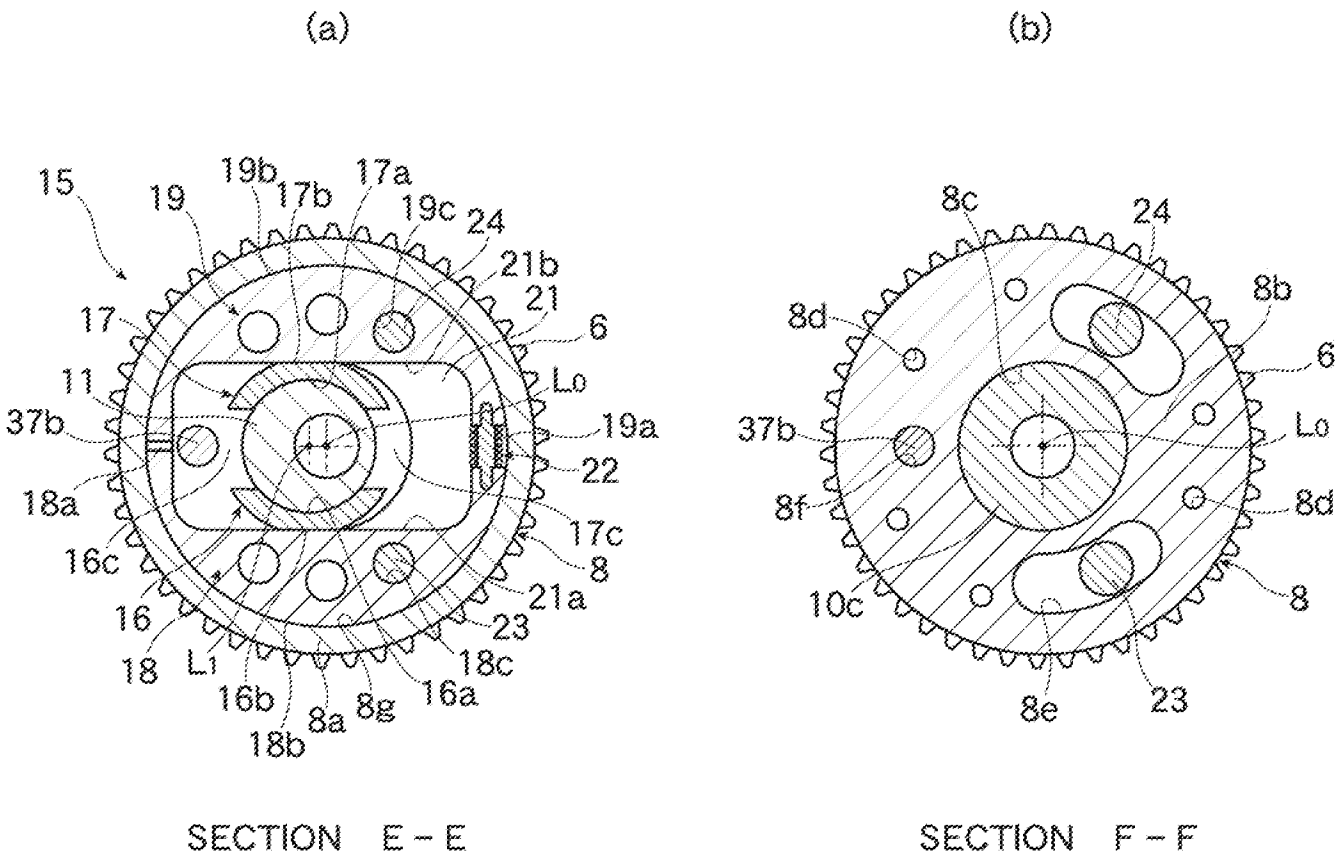
FIGS. 6(*a*) and (*b*) are cross sections taken along line E-E and F-F in FIG. 4.

The drive cylinder 8 is a bottomed cylinder having a cylinder section 8*a* and a bottom 8*b*. The drive cylinder 8 has a central circular hole 8*c*, a multiplicity of pin holes 8*d*, a multiplicity of grooves 8*e* extending along a phantom circumference centered at the L0 as shown in FIG. 6(*b*), and a pin hole 8*f* for receiving therein a shaft member 37 (which will be described in more detail later). The sprocket holder 7 and the drive cylinder 8 are supported by the center shaft 10, with the first cylinder section 10*a*, flange section 10*b*, and second cylinder section 10*c* engaged in the central circular hole 8*c*, stepped circular hole 7*c*, and circular hole 7*d*, respectively.

The flange section 7*a* of the sprocket holder 7 is sandwiched in the axial direction by the drive cylinder 8 and the sprocket 6. The sprocket 6, sprocket holder 7, and drive cylinder 8 are unrotatably integrated together by inserting pins (not shown) in a multiplicity of pinholes 6*b*, pinholes 7*e*, and pinhole 8*d*. Consequently, the drive rotor 2 is arranged coaxially with the center shaft 10 and the camshaft (not shown) and rotatably supported by the center shaft 10 (camshaft, not shown).

A first control rotor 3 is a bottomed cylinder having a flange section 3*a* formed the front edge thereof, a cylinder section 3*b* that extends rearward, and a bottom 3*c*. Formed in the bottom 3*c* are a central circular through-hole 3*d*, a pair of pin holes 12, a groove 13 extending along a phantom circumference centered at the first rotational axis L0 (the groove referred to as circumferential groove 13), and a first curved guide groove 14 having a decreasing radius from the first rotational axis L0 as it extends in the phase advancing direction D1 (the groove referred to as first radius-decreasing guide groove 14). The first control rotor 3 is supported by the third cylinder section 10*d* of the center shaft 10 passing through the central circular through-hole 3*d*.

Lock plate bushes (16 and 17) are mounted on the periphery of the circular eccentric cam 11. The lock plate bushes (16 and 17) are shaped to be a pair of divided half-rings separated by slits (16*c* and 17*c*) as shown in FIGS. 1 and 6(*a*), and have arcuate inner surfaces (16*a* and 17*a*) in engagement with the circular eccentric cam 11 and outer surfaces which are partly cut to form flat surfaces (16*b* and 17*b*).

The peripheries of the lock plate bushes (16 and 17) are supported by two lock plates (18 and 19). The lock plates (18 and 19) are a pair of semi-circular members separated by two slits (18*a* and 19*a*) and together form a generally elongate square groove 21 for holding the lock plate bushes (16 and 17). The lock plates 18-19 hold the lock plate bushes 16-17 by receiving the flat surfaces 16*b*-17*b* in contact with the elongate surfaces 21*a*-21*b* of the groove 21. A slit 19*a* has a larger width than the slit 18*a*. A spring unit 22 is provided in the slit 19*c* to wide the slit 19*a* apart. Arcuate peripheral surfaces 18*b*-19*b* of the lock plates 18-19 are inscribed in the inner periphery 8*g* of the cylinder section cylinder section 8*a* formed at the front end of the drive cylinder 8.

The circular eccentric cam 11 of the center shaft 10, lock plate bushes 16-17, lock plates 18-19, and the cylinder section 8*a* of the drive cylinder 8 constitute a self-lock mechanism 15.

The self-lock mechanism 15 prevents a shift in relative phase angle between the drive rotor 2 (crankshaft) and the center shaft 10 (camshaft) due to an external disturbing torque transmitted from a valve spring to the camshaft. Since one of the lock plates 18-19 is forced against the inner periphery 8*g* of the cylinder section 8*a* depending on the direction of the external disturbing torque inputted to the center shaft 10, the center shaft 10 is unrotatably locked relative to the drive rotor 2 under an external disturbing torque. As a result, the phase angle of the 10 relative to the drive rotor 2 (camshaft) will not be changed by the external disturbing torque.

The lock plates 18-19 are formed with pinholes 18*c*-19*c* for mounting coupling pins 23-24. The coupling pins 23-24 are fixedly secured in the pinholes 18*c*-19*c* such that the pins projects from the pinholes 18*c*-19*c*. The first control rotor 3 is integrated with the center shaft 10 (camshaft) by inserting the leading ends of the coupling pins 23-24, fixed on the lock plates, into pin holes 12. The rear ends of the coupling pins 23-24 engage with circumferential grooves 8*e* of the drive cylinder 8 shown in FIG. 6(*b*).

On the other hand, the second control rotor 4 is a disk in shape having a circular through-hole 4*a* and multiplicity of second guide grooves 25 each extending substantially along the circumference of the disk in the phase retarding direction D2 such that its radius from the axis L0 decreases with the length of the groove. (The guide grooves will be referred to as second radius-decreasing guide grooves 25.) The second control rotor 4 is rotatably mounted on the third cylinder section 10*d* by inserting the third cylinder section 10*d* of the center shaft 10 in the circular through-hole 4*a*. The second control rotor 4 is arranged inside the flange section 3*a*. The first and second control rotors 3-4 are arranged with their front ends (3*e* and 4*d*) flush with each other as shown in FIG. 4. The first and second control rotors 3-4 are secured not to slip off the third cylinder section 10*d* by a holder 42 disposed at the leading end of the third cylinder section 10*d*.

Figure 3:
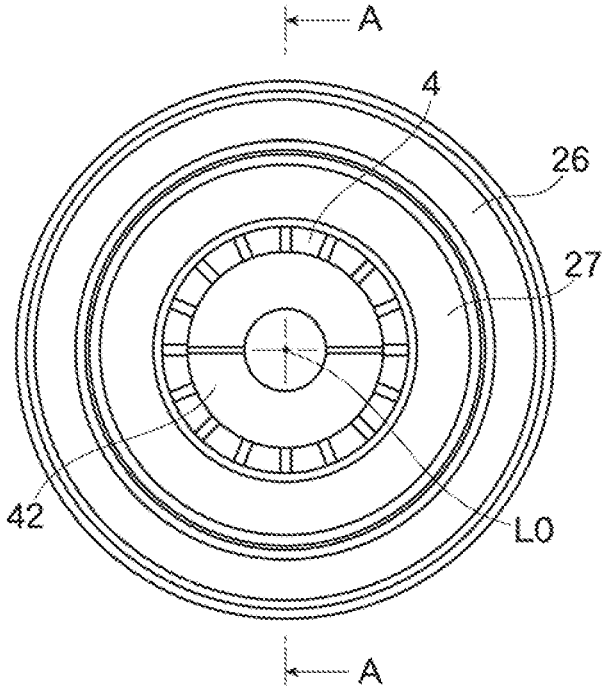
FIG. 3 is a front view of the apparatus of FIG. 1.

On the other hand, a first electromagnetic clutch (first torquing mechanism) 26 and a second electromagnetic clutch (second torquing mechanism) second electromagnetic clutch 27 are arranged ahead of the first and the second control rotors 3-4 as shown in FIG. 3. (The electromagnetic clutches are not shown in other Figures.) The first and second control rotors 3-4, rotating with the center shaft 10, will be retarded in the phase retarding direction D2 when the front ends 3*e*-4*d* of the first and the second control rotors 3-4 are attracted onto the friction member (not shown) by the first and the second electromagnetic clutches 26-27.

On the other hand, the first control rotor 3 is rotated in the phase advancing direction D1 relative to the drive rotor 2 by a reverse rotation mechanism 5 operably linked to the second electromagnetic clutch 27. The reverse rotation mechanism 5 consists of a first operative mechanism 5A and a second operative mechanism 5B. The first operative mechanism 5A has a crank member 28, the first radius-decreasing guide groove 14 formed in the first control rotor 3, and a first pin mechanism 29 mounted on the crank member 28.

Figure 5:
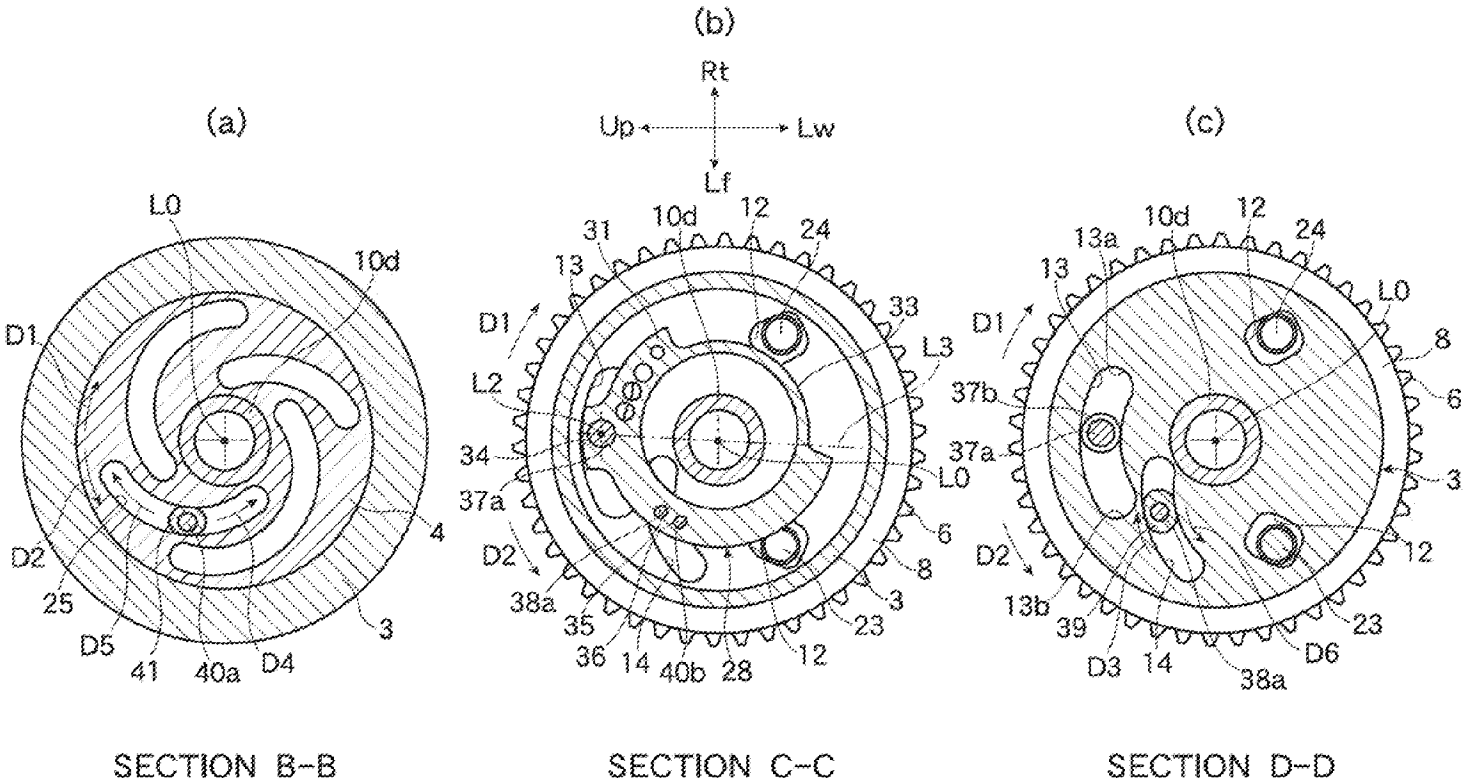
FIG. 5(*a*)-(*c*) are cross sections taken along lines B-B, C-C, and D-D, respectively, in FIG. 4.

The crank member 28 of the first embodiment has a ring body 31 having radially increasing thickness, a protrusion 32 protruding radially outwardly from the ring body 31, and a thinned-out portion 33 formed by partly thinning a circumferential portion of the ring body 31. The thinned-out portion 33 is formed in a region of the crank member 28 well offset from the protrusion 32 in the phase advancing direction D1 as shown in FIG. 5(*b*). The protrusion 32 is formed with a pinhole 34 that penetrates the protrusion 32. The ring body 31 has a first and a second pinholes 35-36. The first and second pin holes 35-36 are formed in a region offset from the protrusion 32 in the phase retarding direction D2 as seen in FIG. 5(*b*).

The crank member 28 receives the leading end of the shaft member 37 in the pinhole 34. The shaft member 37 has a thin shaft 37*a* and a thick shaft 37*b* which is contiguous with the thin shaft 37*a* and has a larger diameter than the thin shaft 37*a*. The thick shaft 37*b* engages with the pin hole 8*f* of the drive cylinder 8, while the thin shaft 37*a* projects forward from a circumferential groove 13 formed in the first control rotor 3 and engages with the pin hole 34 of the crank member 28. The crank member 28 is supported rotatable about a second rotational axis L2 of the shaft member 37.

The first pin mechanism 29 consists of a shaft member 38 and a first hollow elongate circular shaft 39. The shaft member 38 has a thin shaft 38*a*, an intermediate shaft 38*b*, and a thick shaft 38*c*, all formed contiguously in the order mentioned. The first hollow elongate circular shaft 39 has an outline that fits the curved walls of the first radius-decreasing guide groove 14. The intermediate shaft 38*b* of the shaft member 38 engages with a central circular hole 39*a* formed in the first hollow elongate circular shaft 39. The thick shaft 38*c* prevents the first hollow elongate circular shaft 39 from slipping off the shaft member 38. Thus, the first hollow elongate circular shaft 39 is rotatably supported by the shaft member 38. The shaft member 38 is inserted in the first radius-decreasing guide groove 14 of the first control rotor 3 from behind. The thin shaft 38*a* projects forward from the first hollow elongate circular shaft 39 and fixedly secured in a first pin hole 35 of the crank member 28. The first hollow elongate circular shaft 39 has the same curvature as that of the first radius-decreasing guide groove 14 and is slidably held in the first radius-decreasing guide groove 14.

A second pin mechanism 30 consists of a shaft member 40 and a second hollow elongate circular shaft 41. The shaft member 40 has a thick shaft 40*a* and a thin shaft 40*b* contiguous with the thick shaft 40*a*. The second hollow elongate circular shaft 41 has an outline that fits in the curvature of the second radius-decreasing guide groove 25. The thick shaft 40*a* of the shaft member 40 engages with a central circular hole 41*a* formed in the second hollow elongate circular shaft 41. so that the second hollow elongate circular shaft 41 is rotatably supported by the shaft member 40. The shaft member 40 is inserted in the second radius-decreasing guide groove 25 of the second control rotor 4 from behind. The thin shaft 40*b* is fitted in a second pinhole 36 formed in the crank member 28 from front, and fixedly secured therein. The second hollow elongate circular shaft 41 is slidably held in the second radius-decreasing guide groove 25.

Next, modes of varying the phase angle between the center shaft 10 (camshaft, not shown) and the drive rotor 2 (crankshaft, not shown) by the first and the second electromagnetic clutches 26-27 will now be described. Normally, the first and the second control rotors 3-4 are rotating together with the drive rotor 2 in the D1 direction (FIGS. 1 and 5(*c*)). When the front end 3*e* of the first control rotor 3 is attracted onto the first electromagnetic clutch 26 for braking, the first control rotor 3 and the center shaft 10 are retarded in the D2 direction relative to the drive rotor 2. Consequently, the phase angle of the center shaft 10 (camshaft) relative to the drive rotor 2 (crankshaft) is varied in the phase retarding direction D2 to thereby change the opening/closing timing of the valve (not shown).

Meanwhile, the first hollow elongate circular shaft 39 shown in FIG. 5(*c*) is moved in the first radius-decreasing guide groove 14 in the substantially clockwise direction D3 as it is guided by the first radius-decreasing guide groove 14. Since the thin shaft 38*a* shown in FIG. 5(*b*) is moved in the first radius-decreasing guide groove 14 in the D3 direction, the shaft member 40, connected to the crank member 28, is moved radially inward direction of the first control rotor 3. Meanwhile, the second hollow elongate circular shaft 41 of FIG. 5(*a*) is moved in the second radius-decreasing guide groove 25 in the counterclockwise direction D4, exerting a radially inward force to the inner periphery of the second radius-decreasing guide groove 25, the second control rotor 4 is rotated in the phase advancing direction D1 relative to the first control rotor 3 and the center shaft 10. Noted that the thin shaft 37*a* shown in FIG. 5(*b*)-(*c*), is moved in the a groove extending in the circumferential direction ( ) the groove referred to as circumferential groove) 13 in the clockwise direction D1, between the opposite ends 13*a*-13*b* of the circumferential groove 13 serving as stoppers for the thin shaft 37*a*.

On the other hand, upon activation of the second electromagnetic clutch 27, the front end 4*b* of the second control rotor 4 shown in FIG. 5(*a*) is attracted, which causes the second control rotor 4 to be retarded in D2 direction relative to the first control rotor 3 and the center shaft 10. Under a reaction of the inner wall of the second radius-decreasing guide groove 25, the second hollow elongate circular shaft 41 is moved in the second radius-decreasing guide groove 25 in substantially the clockwise direction D5, so that the shaft member 38 connected with the crank member 28 is moved in a radially outward direction. Meanwhile the first hollow elongate circular shaft 39 shown in FIG. 5(*c*) is moved in the substantially counterclockwise direction D6, exerting a radially outward force to the inner wall of the first radius-decreasing guide groove 14. Consequently, the first control rotor 3 and the center shaft 10 are moved in the phase advancing direction D1 relative to the drive rotor 2. As a result, the phase angle of the center shaft (camshaft) relative to the drive rotor 2 is advanced in the direction D1, thereby varying again the opening/closing timing of the valve.

It is noted that since the 38-shaft member 40 are mounted on the crank member 28 so that their axes will not be inclined with respect to the crank member 28. Consequently, the first hollow elongate circular shaft 39 and the-second hollow elongate circular shaft 41 can smoothly move in the first and the second radius-decreasing guide grooves (14 and 25), respectively, without being subjected to local frictions that may take place if the 38-shaft member 40 are inclined with respect to the crank member 28.

Note that the region of the ring body 31 in the phase advancing direction (region in D1 direction) has a smaller weight than in the phase retarding region (region in D2 direction) due to the fact that the crank member 28 of the first embodiment has the thinned-out portion 33. Consequently, the center of gravity of the crank member 28 is located in the region of the ring body 31 away from the protrusion 32 in D2 direction. That is, denoting by L3 a line passing through the first rotational axis L0 and the second rotational axis L2 of the shaft member 37 as shown in FIG. 5(*b*), the center of gravity of the crank member 28 is located in the region left (indicated by Lf) to the line L3, so that the crank member 28 is subjected to a torque and tends to rotate in the D2 direction about the second rotational axis L2 due to its own weight. Thus, assisted by this torque, the first hollow elongate circular shaft 39 moves in the first radius-decreasing guide groove 14 in substantially the clockwise direction D3, as shown in FIG. 5(*c*). Consequently, the phase angle of the center shaft (camshaft) relative to the drive rotor 2 (crankshaft) tends to vary more easily in the phase retarding direction D2 than the phase advancing direction D1. This is also the case in the second and third embodiments described in detail later. (The second rotational axis is denoted by L4 in the third embodiment.)

Referring to FIGS. 7 through 10, there is shown a phase varying apparatus for an automobile engine in accordance with a second embodiment of the invention. In a phase varying apparatus 50 of the second embodiment, a crank member 51 differs from the corresponding crank member 28 of the first embodiment in that the crank member 51 has different shape and arrangement than those of the crank member 28. Further, a second operative mechanism 5C has a different configuration than that of corresponding operative mechanism. However, other structural features of the second embodiment are the same as of the first embodiment. The second operative mechanism 5C has a single pin mechanism 52 and a pin mechanism second radius-decreasing guide groove 25. The single pin mechanism 52 replaces the pin mechanism 29 and another pin mechanism 30 that are separated by the crank member 28 in two parts in the first embodiment.

Figure 7:
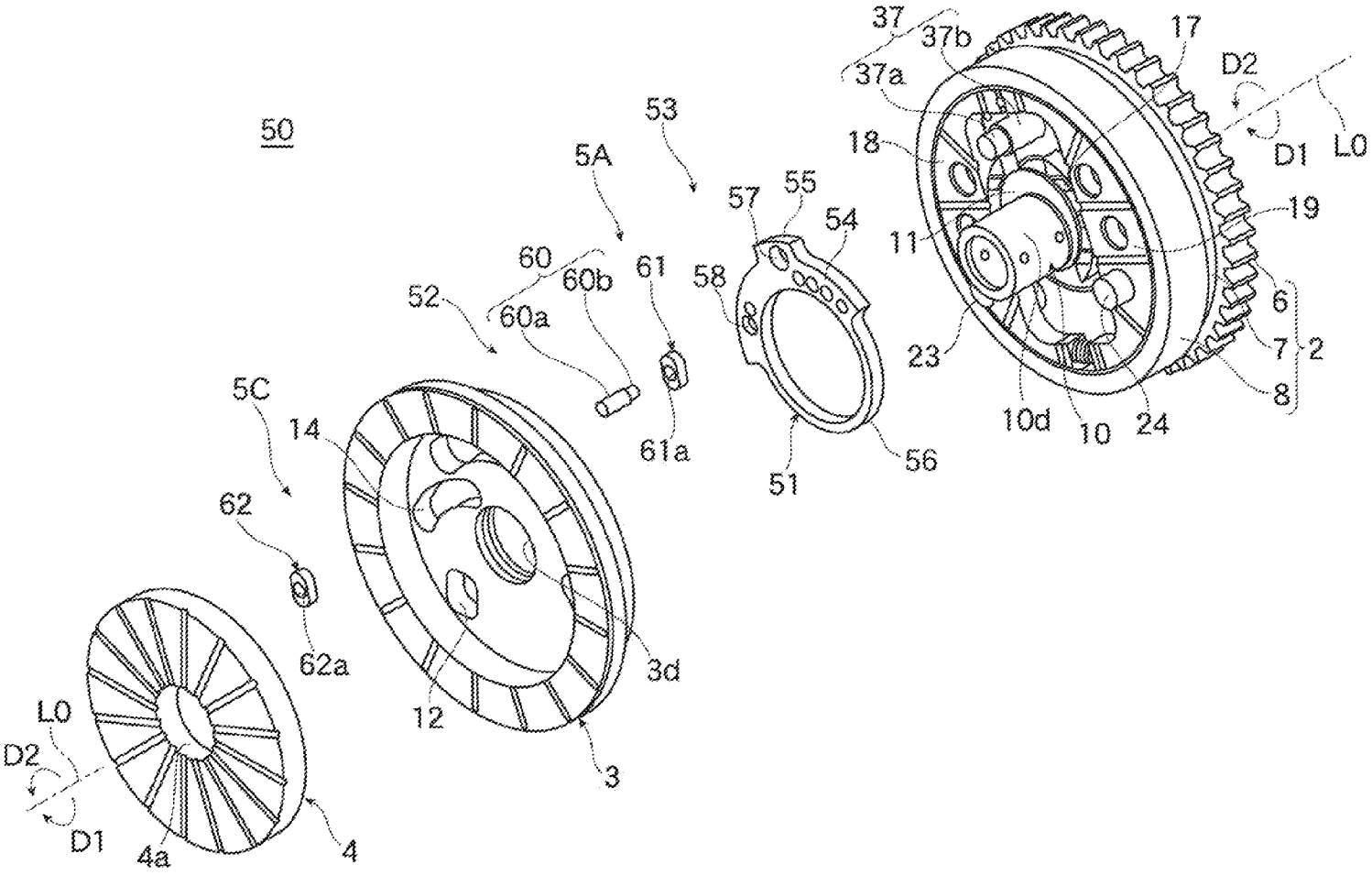
FIG. 7 is an exploded perspective view of a phase varying apparatus according to a second embodiment of the invention.
Figure 10:
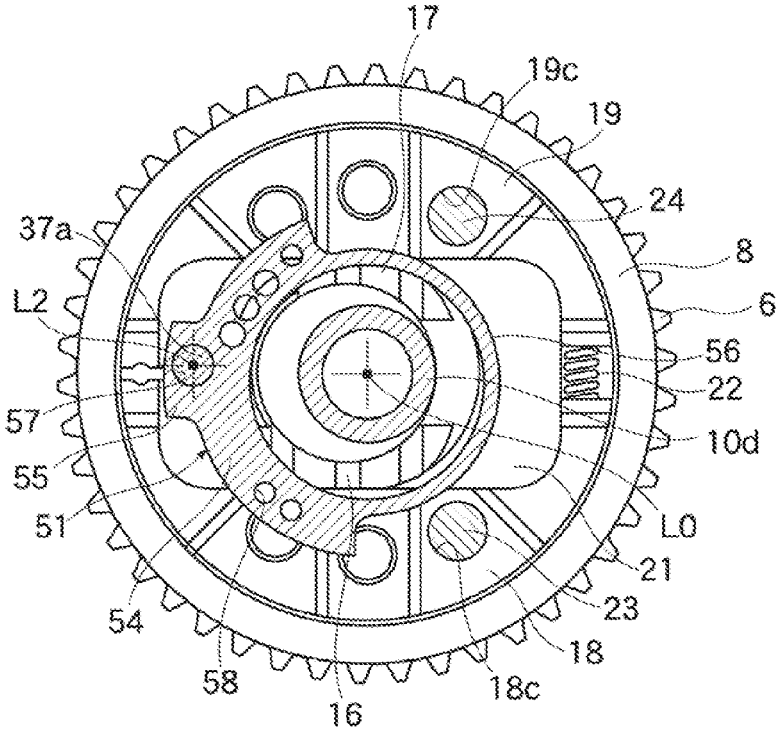
FIG. 10 is a cross section taken along line G-G in FIG. 9.

A reverse rotation mechanism 53 of the second embodiment comprises a crank member crank member 51, the first radius-decreasing guide groove 14 of the first control rotor 3, the second radius-decreasing guide groove 25 of the second control rotor 4, and the pin mechanism single pin mechanism 52 mounted on the crank member 51. The crank member 51 has a ring body 54 having a ring section and a protrusion 55 that projects radially outwardly from the ring body 54, the ring section having a radially thick portion and a thinned-out portion 56 formed by thinning approximately half the circumference of the ring body 54. The protrusion 55 is formed with a through pin hole 57. The ring body 54 is formed with a through-pin hole 58 in a region that extends from the protrusion 55 in the D2 direction (FIGS. 7 and 10).

Figure 9:
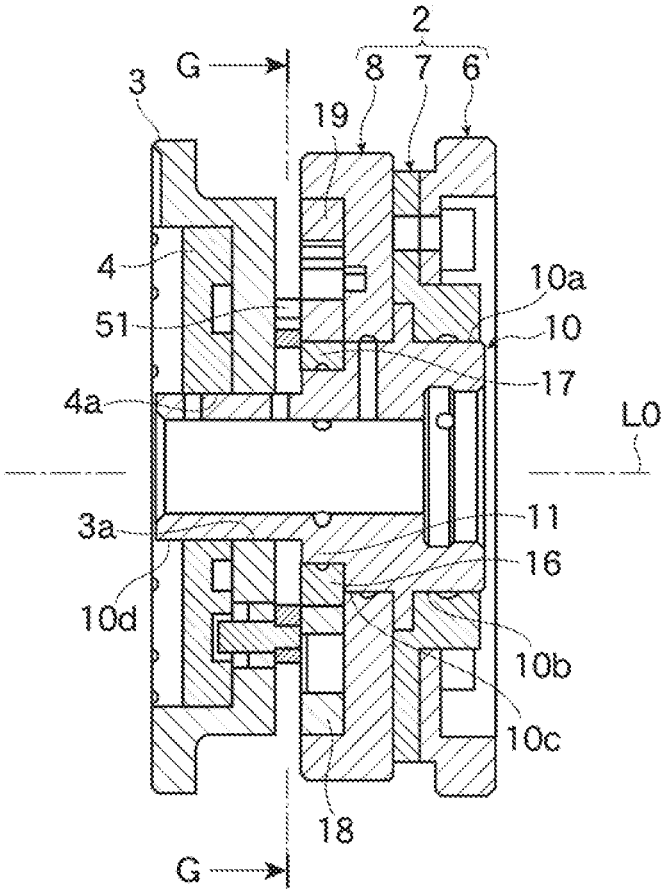
FIG. 9 is a cross section of the phase varying apparatus of the second embodiment, taken along the camshaft axis L0 as in the same manner as in FIG. 4.

The crank member 51 shown in FIG. 9 differs from the crank member 28 of the first embodiment as shown in FIG. 4 in that the crank member 51 is disposed adjacent the rear end of the first control rotor 3. As in the first embodiment, the through-pin hole 57 of the crank member 51 is engaged with the thin shaft 37*a* of the shaft member 37 fixed on the drive cylinder 8 of the drive rotor 2, so that the crank member 51 is rotatably supported by the shaft member 37 to rotate about the second rotational axis L2 of the shaft member 37.

The single pin mechanism 52 consists of a shaft member 60, a first hollow elongate shaft 61, and a second hollow elongate shaft 62. The shaft member 60 has a thick shaft 60*a* and a thin shaft 60*b* connected together in the order mentioned. The shaft member 60 is fixedly secured on the crank member 51 by engaging the thin shaft 60*b* in the through-pin hole 58 from the front end thereof. The first hollow elongate shaft 61 and the second hollow elongate shaft 62 have an outline that fits the curved first radius-decreasing guide groove 14 and the second radius-decreasing guide groove 25, respectively, and rotatably supported by the shaft member 60 fixed to the through-pin hole through-pin hole 58 by engaging the thick shaft 60*a* of the 60 with the central circular holes 61*a* and 62*a*. The shaft member 60 is inserted in the first radius-decreasing guide groove 14 of the first control rotor 3 and the second radius-decreasing guide groove 25 of the second control rotor 4 from behind in the order mentioned. The first hollow elongate shaft 61 is movably held in the first radius-decreasing guide groove 14 by being engaged therewith. The second hollow elongate shaft 62 is movably held in the second radius-decreasing guide groove 25 by being engaged in the second radius-decreasing guide groove 25.

Figure 8:
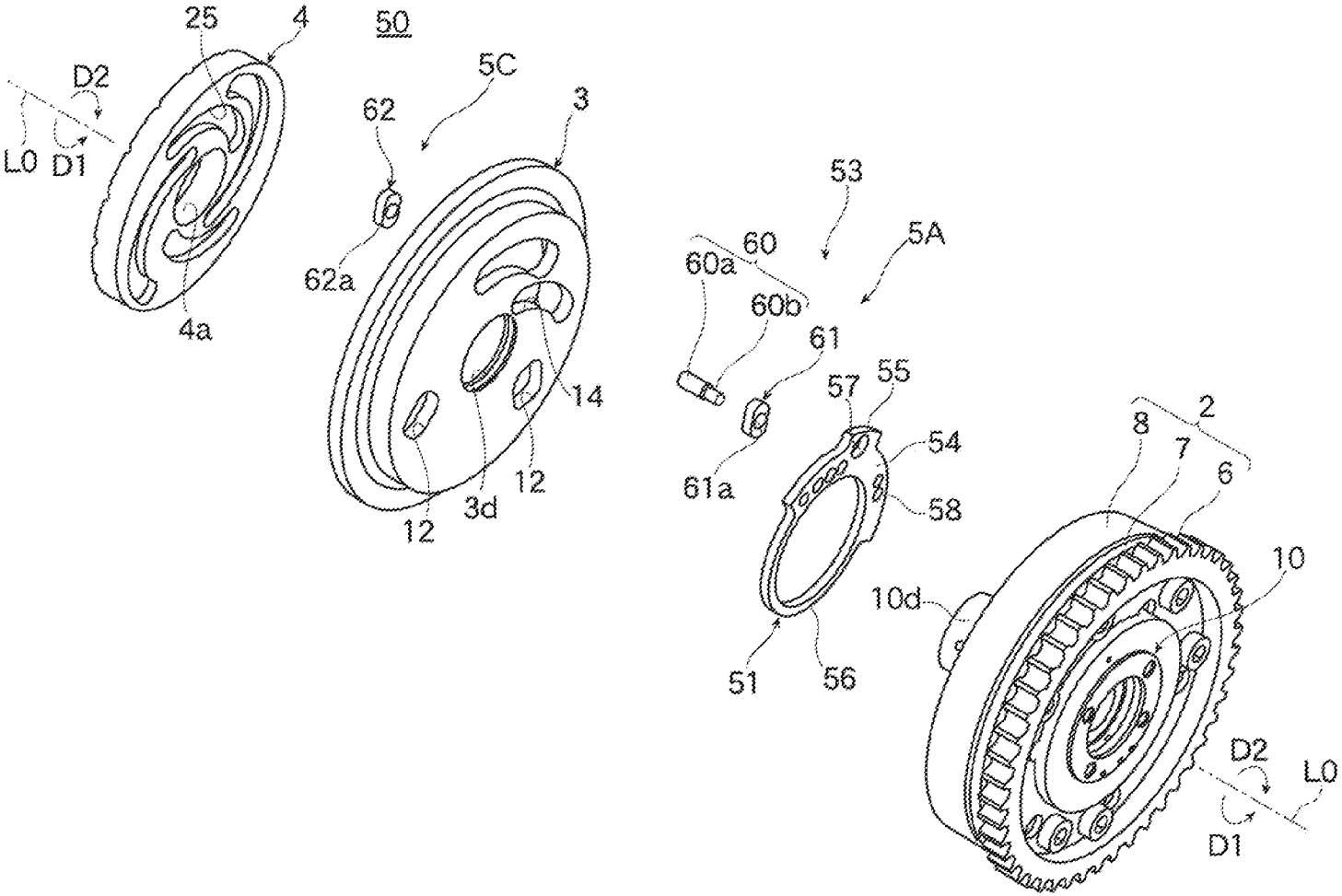
FIG. 8 is a perspective view of the apparatus shown in FIG. 8 as seen from the rear end of the apparatus.

FIGS. 7 through 10 show a phase varying apparatus in accordance with a second embodiment of the invention for varying the phase angle of the center shaft 10 (camshaft)

relative to the drive rotor 2 (crankshaft). Normally, the first control rotor 3 and second control rotor 4 are in rotating together with the drive rotor 2 in D1 direction (FIGS. 7 and 8). However, if the first control rotor 3 say is subjected to a braking force of a first electromagnetic clutch 26 (similar to the first electromagnetic clutch 26 of the first embodiment), the center shaft center shaft 10 (camshaft) integral with the first control rotor 3 will be retarded in D2 direction relative to the drive rotor 2, so that the phase angle of the center shaft (camshaft) relative to the drive rotor 2 is varied in the phase retarding direction D2, varying the opening/closing timing of the valve (not shown) accordingly In this case, the first hollow elongate shaft 61 shown in FIGS. 7 and 8 is guided by the first radius-decreasing guide groove 14 to move therein in substantially the clockwise direction D3 (D3 direction shown in FIG. 5(*c*)). As the first hollow elongate shaft 61 moves in the first radius-decreasing guide groove 14 in the D3 direction (D3 direction shown in FIG. 5(*a*)), the second hollow elongate shaft 62 moves in the second radius-decreasing guide groove 25 in the substantially counterclockwise direction D4, exerting a radially inward force to the inner wall of the second radius-decreasing guide groove 25 and rotating the second control rotor 4 relative to the first control rotor 3 and center shaft 10 in the phase advancing direction D1.

On the other hand, if the second control rotor 4 is subjected to a braking force of the second electromagnetic clutch 27 (as shown in FIG. 3), the second control rotor 4 will be retarded in rotation in the D2 direction relative to the first control rotor 3 and center shaft 10 (FIGS. 7 and 8). Under the external force exerted by the inner wall of the second radius-decreasing guide groove 25, the second hollow elongate shaft 62 is moved in the second radius-decreasing guide groove 25 in the substantially clockwise direction D5 (in the same direction D5 as shown in FIG. 5(*a*)), causing the first hollow elongate shaft 61 mounted on the 60 to be moved in the radially outward direction.

Meanwhile, the first hollow elongate shaft 61 moves in the first radius-decreasing guide groove 14 in substantially clockwise direction D6 (in the same direction D6 shown in FIG. 5(*c*)), exerting a radially outward force to the inner wall of the first radius-decreasing guide groove 14. As a result, the first control rotor 3, which is integral with the center shaft 10, is moved relative to the drive rotor 2 in the phase advancing direction D1. Thus, the phase angle of the center shaft (camshaft) relative to the drive rotor 2 (crankshaft) is advanced in the phase advancing direction D1, varying again the opening/closing timing of the valve.

It is noted that the shaft member 60 is mounted on the crank member 51 so that the shaft member 60 will not incline towards the crank member 51. As in the first embodiment, the first hollow elongate shaft 61 and second hollow elongate shaft 62 mounted on the shaft member 60 can smoothly move in the respective first and second radius-decreasing guide grooves (14 and 25) without being influenced by local frictions due to its inclination.

Figure 11:
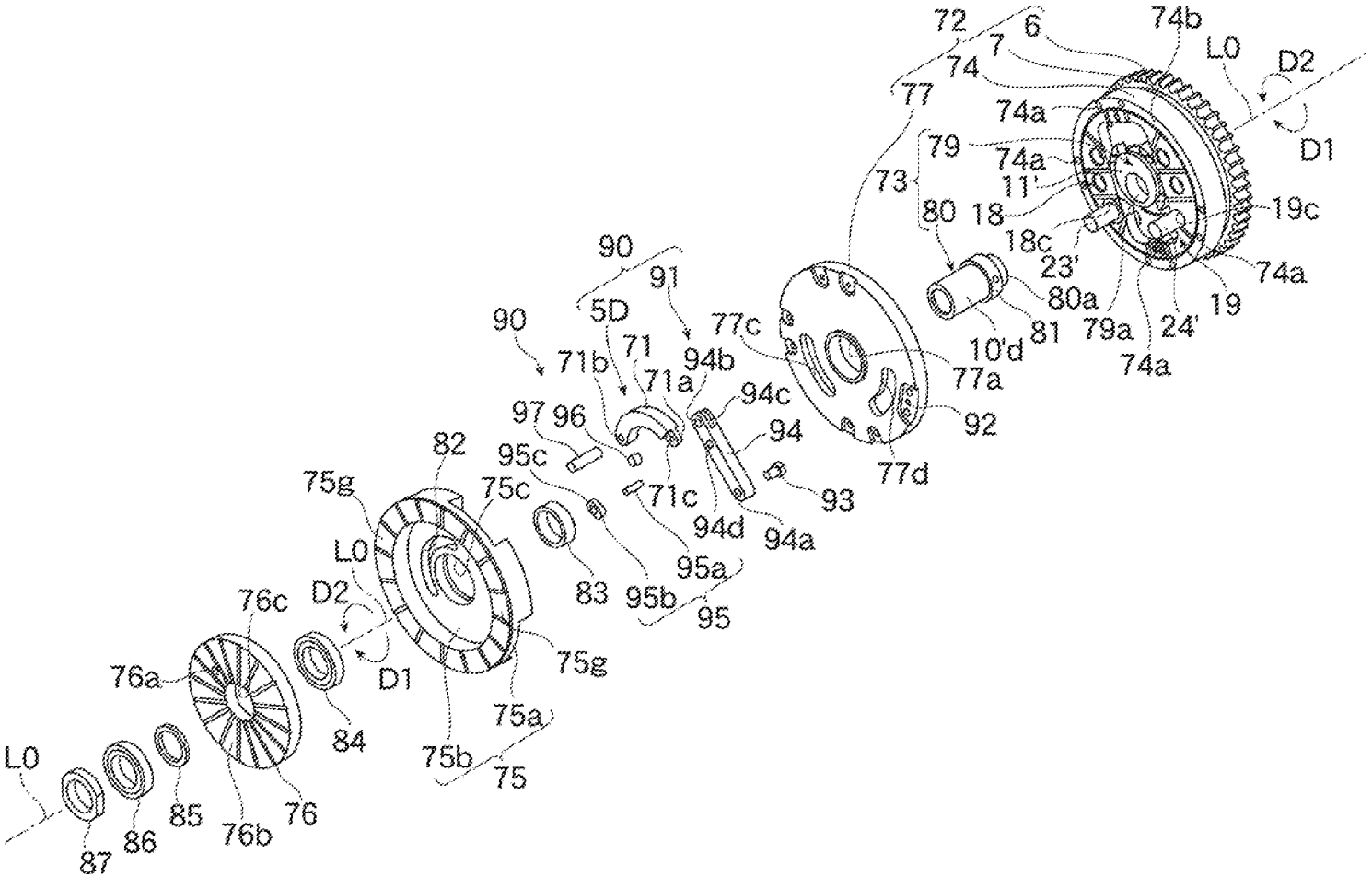
FIG. 11 is a perspective view of a phase varying apparatus according to a third embodiment of the invention, as seen from the front end of the apparatus.
Figure 12:
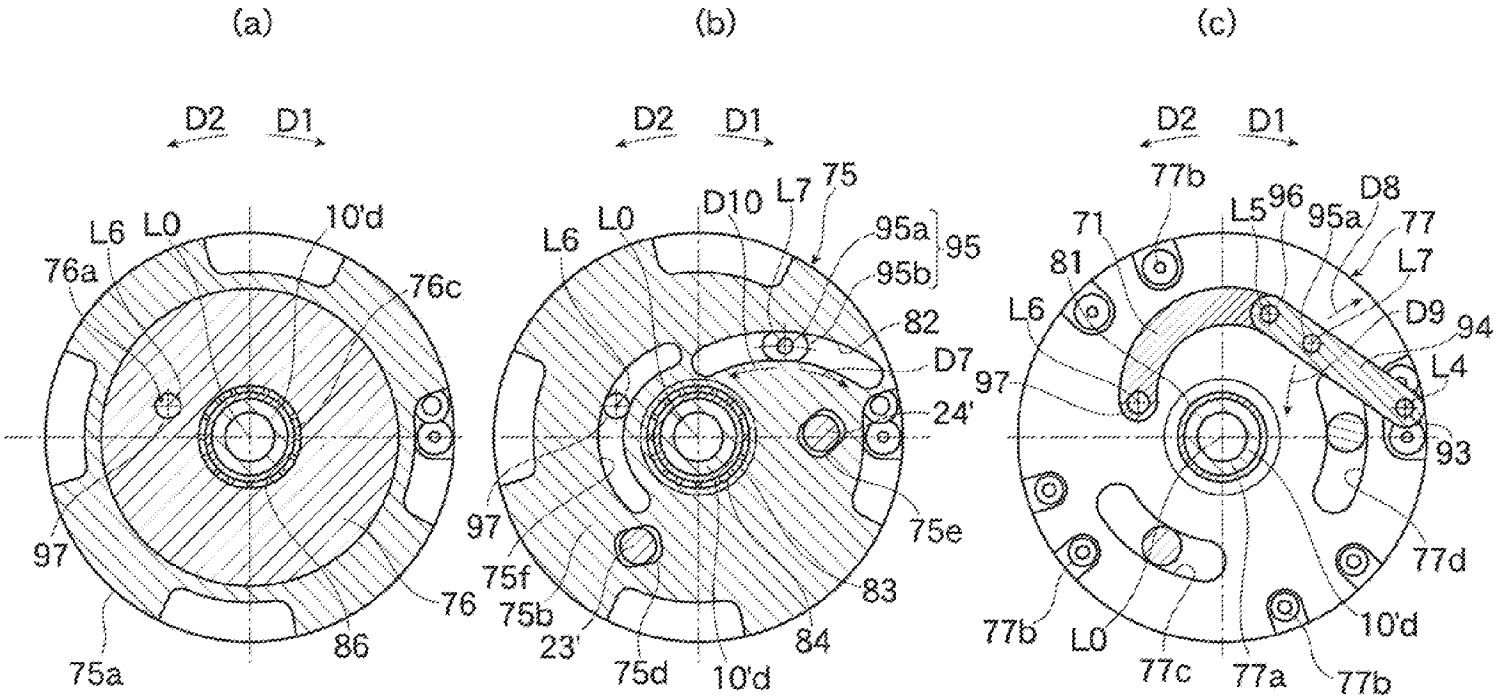
FIG. 12 is a vertical cross section of the apparatus of the third embodiment, as seen from the front end of the apparatus. More particularly, FIG. 12(*a*) shows a vertical cross section of the second control rotor, FIG. 12(*b*) a vertical cross section of the bottom of the first control rotor, and FIG. 12(*c*) a vertical cross section of the second operative mechanism.

Referring to FIGS. 11 and 12, there is shown a phase varying apparatus according to a third embodiment of the invention. A third phase varying apparatus 70 for automobile engine is equipped with a second operative mechanism 5D that replaces the operative mechanism 58 of the first embodiment. The second operative mechanism 5D utilizes a link member 71 in place of the 30 that slidably moves in the second radius-decreasing guide groove 25.

The phase varying apparatus 70 has a similar structure to that of the phase varying apparatus of the first embodiment, except for a drive rotor 72, a center shaft 73, coupling pins 23' and 24', a first control rotor 75, a second control rotor 76, and the second operative mechanism 5D, which have different structures as compared with corresponding counterparts of the first embodiment.

The drive rotor 72 consists of the sprocket 6, sprocket holder 7, a drive cylinder 74 and an intermediate rotor 77. The drive cylinder 74 has the same configuration as the drive cylinder 8 of the first embodiment, except that it has no drive cylinder 8 nor shaft member 37 (See FIGS. 1 and 6(*b*)), and that it has a multiplicity of threaded holes 74*a* for fixing the intermediate rotor 77. The threaded holes 74*a* are formed in the front end 74*b* of the drive cylinder 74.

The center shaft 73 comprises a fourth cylinder section 81 having a diameter larger than that of the third cylinder section 10*d* located ahead of the circular eccentric cam 11 of the center shaft 10 of the first embodiment. The center shaft 73 also comprises: a first cylinder section (not shown) having the same configuration as the first cylinder section of the first embodiment; a first shaft section 79 consisting of a flange (not shown) and an circular eccentric cam 11'; and a third cylinder section 10'*d* having the same diameter as the corresponding counterpart of the first embodiment and a fourth cylinder section 81 formed on a base of the third cylinder section 10'*d*. The second shaft section 80 has a mount section 80*a* engaged with a mounting hole 79*a* formed at the leading end of a first shaft section 79, so that the second shaft section 80 is coaxially and fixedly secured to the first shaft section 79.

The sprocket 6, sprocket holder 7, and drive cylinder 74 are mounted on the center shaft 73 rotatably about the first rotational axis L0, surrounding the first cylinder section (not shown) and the flange section (not shown) behind the circular eccentric cam 11' as in the first embodiment. Provided on the periphery of the circular eccentric cam 11 arranged inside the drive cylinder 74 are lock plate bushes 16-17, lock plates 18-19, and a spring mechanism 22, all having the same structures as the corresponding counterparts of the first embodiment.

The intermediate rotor 77 is rotatably supported by the center shaft 73 by engaging the fourth cylinder section 81 with the central circular hole 77*a* of the intermediate rotor 77. The intermediate rotor 77 is secured to the front end 74*b* of the drive cylinder 74 by a multiplicity of screws 77*b* screwed into a multiplicity of threaded holes threaded holes 74*a*. Consequently, the drive rotor 72 is rotatably mounted on the center shaft 73 rotatably about the first rotational axis L0.

The coupling pins 23'-24' are fixed in the mounting holes 18*c*-19*c* of the lock plates 18-19 such that the coupling pins 23'-24' project forward longer than the coupling pins 23-24 of the first embodiment. The coupling pins 23'-24', when fitted in a pair of circumferential grooves (escape grooves 77*c* and 77*d*) formed in the intermediate rotor 77 in association with the coupling pins 23'-24', the intermediate rotor 77, project forward out of these grooves.

The first control rotor 75 has a cylinder section 75*a* and a bottom 75*b* contiguous therewith in the axial direction. Formed in the bottom 75*b* are a central circular through hole 75*c*, a pair of pin holes 75*d*-75*e*, a groove 75*f* that extends in the circumferential direction of a phantom circle centered about the first rotational axis L0, and a first radius-decreasing guide groove 82 having a decreasing radius from the first rotational axis L0 in the phase retarding direction as seen from the front end of the apparatus.

The first control rotor 75 is mounted on the third cylinder section 10*d* of the center shaft 73 coaxially with the center shaft 73 (coaxially with the first rotational axis L0) using a pair of bushes 83-84 fitted in a circular through-hole central circular through hole 75*c*. Furthermore, the first control rotor 75 is unrotatably integrated with the center shaft 73 by inserting the coupling pins 23'-24', that project from the intermediate rotor 77 in the forward direction, into a pair of pin holes 75*d*-75*e*.

The second control rotor 76 has a circular through hole 76*a* penetrating the second control rotor 76 in the axial direction, The second control rotor 76 is rotatably mounted on the third cylinder section 10'*d* of the center shaft 73 coaxially with the center shaft 73 (first rotational axis L0) using a pair of bushes fitted in the central circular through-hole 76*c*. The second control rotor 76 is arranged inside the 7 first operative mechanism 5A with its front end 76*b* being flush with the front end 75*g* of the first control rotor 75. The first and the second control rotors 75-76 are prevented from slipping off the third cylinder section 10'*d* by a holder 87 mounted on the front end of the third cylinder section 10'*d*.

Arranged in front of the first and the second control rotors 75-76 are a first and a second electromagnetic clutches 26-second electromagnetic clutch 27 as in the first embodiment (these clutches are not shown in FIGS. 11 and 12.) When the 75-second control rotor 76 are attracted by the 26-second electromagnetic clutch 27 with their front ends brought into contact with a friction member (not shown) of the clutches, the 75-second control rotor 76 in rotation together with the center shaft 73 are retarded in the direction D2 relative to the drive rotor 72.

Provided between the intermediate rotor 77 and the first control rotor 75 is a reverse rotation mechanism 90 which comprises a first operative mechanism 91 and a second operative mechanism 5D. The first operative mechanism 91 has a first radius-decreasing guide groove 82 formed in the first control rotor 75, a circular hole 92 formed in the intermediate rotor 77, a shaft member 93, a rod shape crank member 94, and a first pin mechanism 95. The second operative mechanism 5D has the link member 71, shaft members 96-shaft member 97 and a circular through-hole 76*a* formed in the second control rotor 76.

The circular hole 92 is formed in the intermediate rotor 77 at a position near the periphery thereof, with its opening facing the front end of the intermediate rotor 77. The crank member 94 has a circular through-hole 94*a* formed at one end and a longitudinal recess 94*c* in the other end. The recess 94*c* is provided with a pair of circular through-hole 94*b* penetrating the recess in the axial direction. The crank member 94 is formed, at an intermediate position thereof, with a circular through-hole 94*d*. The link member 71 is provided at one end thereof with a convex 71*a* in engagement with the recess 94*c*, and at the other end thereof with a circular through-hole 71*b*. The convex 71*a* is formed with a circular through-hole 71*c*.

The shaft member 93 is fitted in the circular hole 92 of the intermediate rotor 77 such that the shaft member 93 protrudes in the forward direction. The crank member 94 is supported by the intermediate rotor 77 so as to be rotatable about the center L4 of the shaft member 93 by engaging the shaft member 93 in the through-hole 94*a*.

The 97 is passed through the circular through-hole 76*a* of the second control rotor 76 and through a circumferential groove 75*f* formed in the 76 first control rotor 75. The link member 71 is supported at one end thereof by the crank member 94 so as to be rotatable about the center L5 of the shaft member 96 by engaging the convex 71*a* in the recess 94*c* and engaging the shaft member 96 in the circular through holes 71*c* of the link member 71 as well as in a circular through hole 94*b* of the crank member 94. On the other hand, the other end of the link member 71 is supported by the second control rotor 76 so as to be rotatable about the center L6 of the 97 by engaging the shaft member 97 in the circular through-hole 71*b*.

The first pin mechanism 95 consists of a shaft member 95*a* and a hollow oblong shaft 95*b*. The shaft member 95*a* is passed through the circular through-hole 94*d* of the crank member 94 with its end projecting therefrom. The hollow elongate shaft 95*b* is supported by the crank member 94 rotatable about the center L7 of the shaft member 95*a* by engaging the shaft member 95*a* with the central circular through-hole 95*c*. The hollow elongate shaft 95*b* is movably held in the first radius-decreasing guide groove 82 of the first control rotor.

Next, a scheme of varying the phase angle between the center shaft 73 (camshaft, not shown) and the drive rotor 72 (crankshaft, not shown) performed when the first and the second electromagnetic clutches 26-27 are energized will be described. Normally, the 75-second control rotor 76 are in rotation together with the drive rotor 72 in the D1 direction (FIG. 12(*a*)-(*c*)).

As the front face 75*g* of the first control rotor 75 is attracted by the first electromagnetic clutch 26, the first control rotor 75 is retarded in rotation relative to the drive rotor 72 in the D2 direction. Since the first control rotor 75 and center shaft 73 are integrated together, the relative phase angle of the center shaft 73 (camshaft) relative to the drive rotor 72 (crankshaft) is retarded in D2 direction, thereby varying the opening/closing timing of the valve (not shown).

In this case, the first control rotor 75 shown in FIG. 12(*b*) is retarded in the D2 direction relative to the intermediate rotor 77 which is integral with the drive rotor 72, and so is the first radius-decreasing guide groove 82 relative to the intermediate rotor 77 in the same direction. Meanwhile, the hollow elongate shaft 95*b* is guided by the first radius-decreasing guide groove 82 to move therein in the substantially clockwise direction D7, and causes the shaft member shaft member 95*a* to be moved in the radially outward direction of the first control rotor 75. Consequently, the crank member 94 shown in FIG. 12(*c*) rotates together with the shaft member 96 in the clockwise direction D8 about a center L4. Since one end of the link member 71, linked to the crank member 94, is pulled by the shaft member 96 in the direction D8, the second control rotor 76 (FIG. 12(*a*)) coupled to the other end of the link member 71 via the shaft member 97 is rotated in the phase advancing direction D1.

On the other hand, when the second electromagnetic clutch 27 (not shown) is energized, the front end of the second control rotor 76 of FIG. 12(*a*) is attracted to the second electromagnetic clutch 27, the second control rotor 76 is retarded in the D2 direction relative to the first control rotor 75. Meanwhile, the shaft member 97 rotates about the first rotational axis L0, which in turn causes the link member 71 to be pulled by the shaft member 97, thereby moving the shaft member 96 shown in FIG. 12(*c*) in the radially inward direction of the intermediate rotor 77. At the same time, the crank member 94 rotates, together with the shaft member 96, in the counterclockwise direction about the rotational axis L4. Then, the hollow elongate shaft 95*b* shown in FIG. 12(*b*) moves in the first radius-decreasing guide groove 82 in the substantially counterclockwise direction D10, exerting a radially inward force to the inner wall of the first radius-decreasing guide groove 82. Consequently, the first control rotor 75 and the center shaft 73 rotate in the phase advancing direction relative to the drive rotor 2. Thus, the phase angle of the center shaft 73 (camshaft) relative to the drive rotor 72 (crankshaft) is advance in the direction D1, again changing the opening/closing timing of the valve (not shown).

The phase varying apparatus 70 for an automobile engine in accordance with a third embodiment has the crank member 94 and the second control rotor 76 linked by link member 71 without using the pin mechanisms (30, 52) that slide in the second radius-decreasing guide groove 25 of the first and the second embodiments. Consequently, in varying the phase angle of the camshaft relative to the crankshaft in the third embodiment, friction involved in the second operative mechanism 5D is greatly reduced as compared with the first and the second embodiment. Thus, the phase varying apparatus 70 has a better response to a phase angle variation between the camshaft and the crankshaft than the phase varying apparatuses (1 and 50) of the first and the second embodiments.

BRIEF DESCRIPTION OF SYMBOLS

1 phase angle varying apparatus for automobile engine
2 drive rotor
3 first control rotor
4 second control rotor
5 reverse rotation mechanism
5A first operative mechanism
10 center shaft integrated with camshaft
14 first radius-decreasing guide groove
25 second radius-decreasing guide groove
26 first electromagnetic clutch
27 second electromagnetic clutch
28 crank member
29 first pin mechanism
30 second pin mechanism
50 phase varying apparatus for automobile engine
51 crank member
52 pin mechanism
53 reverse rotation mechanism
5C second operative mechanism
70 phase varying apparatus for automobile engine
71 link member
72 drive rotor
73 center shaft integrated with camshaft
75 first control rotor
76 second control rotor
90 reverse rotation mechanism
5D second operative mechanism
82 first radius-decreasing guide groove
94 crank member
95 first pin mechanism
L0 axis of camshaft (first rotational axis)
L2 and L4 rotational axes of crank member mounded on drive rotor (second rotational axis)
L3 line passing through L2
Up upward direction with respect to L2
Lw downward direction with respect to L2
Lf direction to the left of line L3

The invention claimed is:

1. A phase varying apparatus for an automobile engine, comprising:

a camshaft;

a drive rotor coaxially mounted on the camshaft, the drive rotor being rotatable about a first rotational axis under a torque exerted by the crankshaft;

a first control rotor integral with and coaxial with the camshaft;

a second control rotor coaxially and rotatably mounted on the camshaft;

a first torquing mechanism for rotating the first control rotor relative to the drive rotor;

a second torquing mechanism for rotating the second control rotor relative to the first control rotor; and a reverse rotation mechanism for rotating the first control rotor relative to the drive rotor in association with the second torquing mechanism, in the opposite rotational direction as compared with the rotational direction caused by the action of the first torquing mechanism, the phase varying apparatus characterized in that the reverse rotation mechanism comprises:

a first operative mechanism having a first radius-decreasing guide groove formed in the first control rotor to extend substantially along the circumference of the first control rotor such that the radius of the first radius-decreasing guide groove from the first rotational axis decreases with the length of the groove, a crank member mounted on the drive rotor rotatably about a second rotational axis which is offset from the first rotational axis, and a first pin mechanism mounted on the crank member such that the pin mechanism is in engagement with the first radius-decreasing curved guide groove slidably in one direction of the first radius-decreasing guide groove under the action of the first torquing mechanism; and a second operative mechanism for rotating the first control rotor relative to the drive rotor in the opposite rotational direction with respect to the rotation thereof caused by the action of the first torquing mechanism, by moving the first pin mechanism in the first radius-decreasing guide groove in the other direction, under the action of the second torquing mechanism.

2. The phase varying apparatus for an automobile engine according to claim 1, wherein the second operative mechanism has:

a second radius-decreasing guide groove formed in the second control rotor to extend substantially along the circumference of the second control rotor in the opposite direction as compared with the first radius-decreasing guide groove such that the radius of the second radius-decreasing guide groove from the first rotational axis decreases with the length of the groove; and a second pin mechanism mounted on the crank member and slidably engaged with the second radius-decreasing curved guide groove.

3. The apparatus according to claim 2, wherein the first and the second pin mechanisms are integrated as a single pin mechanism which is slidable in both of the first and the second radius-decreasing guide grooves.

4. The apparatus according to claim 2, wherein the center of gravity of the crank member is offset either to the right or left of the line passing through the first and the second rotational axes.

5. The apparatus according to claim 3, wherein the center of gravity of the crank member is offset either to the right or left of the line passing through the first and the second rotational axes.

6. The apparatus according to claim 1, wherein the second operative mechanism has a link member with one end thereof rotatably mounted on the crank member and another end rotatably mounted on the second control rotor.

7. The apparatus according to claim 6, wherein the center of gravity of the crank member is offset either to the right or left of the line passing through the first and the second rotational axes.

8. The apparatus according to claim 1, wherein the center of gravity of the crank member is offset either to the right or left of the line passing through the first and the second rotational axes.

* * * * *